United States Patent [19]

Pfeiffer et al.

[11] Patent Number: 4,898,496

[45] Date of Patent: Feb. 6, 1990

[54] APPARATUS FOR UNDERGROUND TUNNELING

[75] Inventors: Ludwig Pfeiffer, Kassel; Wilfried Werner, Zierenberg, both of Fed. Rep. of Germany

[73] Assignee: MTS Minitunnelsysteme GmbH, Kassel, Fed. Rep. of Germany

[21] Appl. No.: 241,005

[22] Filed: Sep. 2, 1988

[30] Foreign Application Priority Data

Sep. 4, 1987 [DE] Fed. Rep. of Germany ..... 3729561

[51] Int. Cl.[4] ..... E21D 9/08

[52] U.S. Cl. ..... 405/141; 299/31; 405/138

[58] Field of Search ..... 405/138, 141, 146, 139, 405/140, 184; 299/31, 33

[56] References Cited

U.S. PATENT DOCUMENTS

| | | | |
|---|---|---|---|
| 3,935,910 | 2/1976 | Gaudy et al. | 405/141 X |
| 4,077,670 | 3/1978 | Spies et al. | 405/141 X |
| 4,369,002 | 1/1983 | Kostylev et al. | 405/138 X |
| 4,407,622 | 10/1983 | Ito | 405/138 X |

FOREIGN PATENT DOCUMENTS

| | | | |
|---|---|---|---|
| 1811449 | 6/1970 | Fed. Rep. of Germany . | |
| 2430459 | 1/1976 | Fed. Rep. of Germany . | |
| 3000683 | 7/1981 | Fed. Rep. of Germany | 405/138 |

*Primary Examiner*—Dennis L. Taylor

[57] ABSTRACT

The invention relates to an apparatus for underground tunneling. It has a working tube which can be driven in the drilling direction and a digging unit mounted therein, and it has a cutterhead which can be shifted back and forth and radially of the axis of the apparatus. When the cutterhead is not deflected radially, the entire digging unit has a substantially smaller cross section than corresponds to the internal cross section of the working tube. A scoop disposed on the floor of the working tube and provided with a shovel-like mouth at its front end serves for the simple and cost-effective removal of the earth loosened by the cutterhead. The scoop is at first urged forward out of the working tube by means of a drive mechanism in order to shovel up loosened earth, and then it is withdrawn rearwardly out of the working tube, emptied, and run back again into the working tube.

10 Claims, 5 Drawing Sheets

APPARATUS FOR UNDERGROUND TUNNELING

BACKGROUND OF THE INVENTION

The invention relates to an apparatus for underground tunneling, especially for tunnels of unwalkable cross section, containing: a working tube having an axis, which can be urged forward in the direction of the tunnel in formation, a digging unit which is mounted in the working tube and can be pushed past the front end of the working tube, and which is movable radially of its axis and bears a partial-face cutter for loosening the dirt in front of the working tube and can be set for a substantially smaller outside cross section in comparison to the inside cross section of the working tube, and a carrier system for the removal of the dirt loosened in the driving of the tunnel.

In apparatus of this kind it is known (DE-OS No. 34 23 842) to transport the dirt from the working face back to the starting pit by means of a shovel powered by chains, or a conveyor belt, or a pusher system. The use of such conveyor means is possible because the digging unit has a digging tool in the form of a swiveling ball cutter and therefore it can be set to cut on a substantially smaller cross section than the full interior cross section of the working tube. Such conveyor systems, however, have the disadvantage that as the tunnel bore becomes gradually longer, they have to be lengthened accordingly. In digging very long tunnels of a length of more than 100 meters, for example, this entails a great expenditure of time and material. The same deficiency is encountered in the use of chain conveyors or the like (DE-AS 19 13 182, U.S. Pat. No. 4,232,905) which are known in apparatus that operate in a similar manner. Aside from these, the described conveyor systems, when used in the digging of unwalkable cross sections, i.e., those of 1000 mm diameter or less, are hard to handle on account of the cramped available space, involve many imponderables, and are very much subject to breakdowns. It is furthermore difficult to withdraw them from the work face back to the starting pit for repairs and maintenance and reinstall them at the work face. Lastly, these conveyor systems are subject to severe mechanical wear, so that they often quickly become unusable, since at least those parts that cannot be retrieved from the tunnel can neither be maintained nor repaired in case of necessity.

In underground tunneling by means of digging units which have an outside cross section of substantially the inside diameter of the working tube and a digging tool in the form of a full-face cutterhead, therefore, a flushing liquid is always used for the removal of the dirt (DE-OS 32 04 564). Such systems often cannot be used, however, on account of the hardly avoidable seepage and infiltration of the flushing liquid in the ground, and require troublesome and costly storage and processing equipment to handle the flushing liquid. Also, it is not possible to remove large stones or rock fragments with such systems.

It is the object of the invention to improve the apparatus of the kind described above in such a manner that a trouble-free, long-wearing system will result, which can be retrieved from the tunnel by simple means, whose lengthening requires simple components or none at all, and which therefore can be manufactured at low cost and will be very quick and easy to use.

SUMMARY OF THE INVENTION

The object of the invention is achieved by a carrier system containing a scoop which is movable underneath the digging unit substantially parallel to the working tube axis, and containing a transport system coupled to the scoop. The scoop is mounted on the floor of the working tube such that it can be pushed forward partially past its front end and withdrawn again fully into the working tube, and has at its front end a mouth of shovel-like configuration for the loading of the loosened dirt. The transport system contains a reversible drive mechanism for moving the scoop back and forth when loading, for withdrawing the scoop rearwardly from the working tube for the removal of the dirt, and for returning the scoop into the working tube after it has been emptied.

The invention offers the advantage, on the one hand, that after a section of tunnel has been dug, the scoop needs only to be driven forward out of the working tube in order to fill it with the material loosened from the working face. On the other hand, after it is loaded, the scoop can be retracted into the working tube, hauled through the back end of the working tube into the starting pit, emptied, and then pushed back into the working tube. The scoop thus serves simultaneously as a loader and as a carrier. The working tube can be pushed forward with or without the scoop to prepare to excavate another section of the tunnel. Moreover, the scoop can also be pushed forward and drawn backward repeatedly in the working tube to ram it full with the loosened dirt in a series of successive plunges instead of filling it in a single pass. The entire carrier system can therefore be composed of a few, extremely sturdy parts, can easily be controlled from the starting pit, and if necessary can easily be repaired or maintained by drawing the scoop back into the starting pit.

Additional advantageous features of the invention are to be found in the subordinate claims.

BRIEF DESCRIPTION OF THE DRAWINGS

The invention will be further explained below in connection with an embodiment represented in the appended drawing.

in FIG. 5 the digging unit visible in FIG. 1 has been omitted.

In FIG. 1, the apparatus in accordance with the invention for underground tunneling contains a preferably cylindrical, relatively thin steel working tube 1 with a rail system 2 fastened approximately halfway up its sides, in which a digging unit can move back and forth inside of the tube 1 parallel to the axis 4 of the latter.

Figure 1:
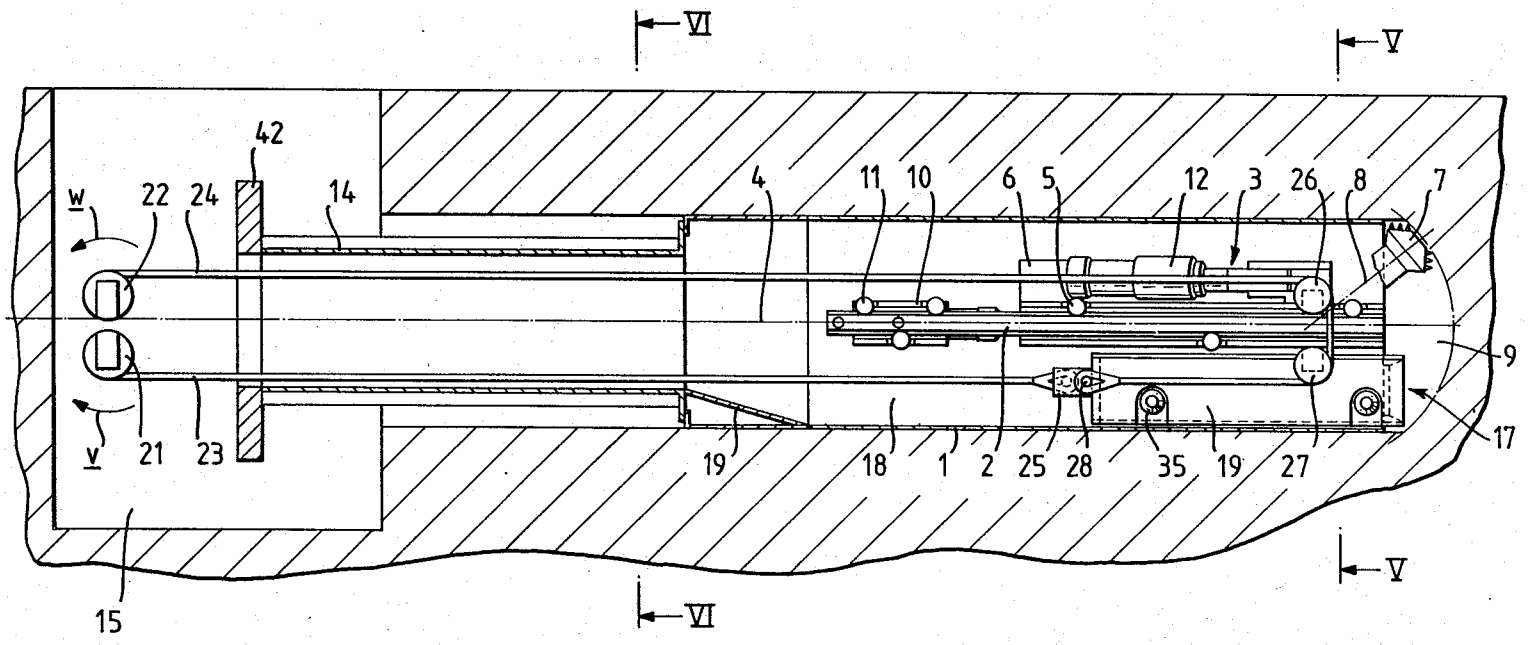
FIG. 1 is a vertical section through an apparatus for underground tunneling, with a carrier system in accordance with the invention.

The rail system 2 contains, for example, two diametrically opposite guide rails disposed parallel to one another and parallel to the axis 4 of the working tube, which are fastened to the inside wall of the working tube 1 and on which run a plurality of wheels 5 of a frame 6 of the digging unit. A mandrel is pivotally mounted in the frame 6 and bears on its front end a cutterhead 7 which is preferably one which can be rotated at high speed, and whose outside diameter is substantially smaller, preferably by at least half, than the inside diameter of the working tube 1. The digging unit 3 furthermore contains a transmission casing with gearing disposed therein, and a motor flange-mounted to the latter for rotating the cutterhead 7 about its momentary axis of rotation 8. The cutterhead 7 is furthermore preferably mounted on the frame 6 so as to be able to move parallel to two axes perpendicular to one another and to the axis 4, or to rotate or rock about this axis, such that it can be shifted as desired within a range of action whose maximum cross section corresponds at least to the outside cross section of the working tube. In this manner it is possible to produce, at the front end of the working tube, a section of tunnel whose cross section, corresponding initially to the diameter of the cutterhead 7, gradually increases to a cross section corresponding, for example, to the outside diameter of the working tube.

The frame 6 is preferably connected to a slide 10 of the digging unit 3, which is likewise carried on wheels 11 in the rail system 2 and can be displaced relative to the latter and parallel to the axis 4. The slide 10 is provided with a locking means by which it can be locked undisplaceably in the working tube 1. Drives mounted in the frame 6 and/or on the carriage 10, and consisting, for example, of hydraulically or pneumatically powered cylinder-piston units or hydraulic motors, serve to actuate the above-described movements of the frame 6 and of the cutterhead 7. A cylinder-and-piston system 12 is represented diagrammatically in FIGS. 1 and 2.

Otherwise, the apparatus described is best constructed as described in detail in DE-PS No. 34 23 842, so that there is no need for further description of this apparatus and its manner of operation.

As FIG. 1 further shows, it may be desirable to have the working tube 1 followed by at least one tube whose inside cross section is smaller than that of the working tube 1. This tube 14 might, for example, be provided as a form for a casing tube to be produced in the tunnel. If such tubes 14 are used, the maximum cross section of the digging unit 3 should therefore be reducible to such an extent, e.g., by aligning the cutterhead with its axis of rotation 7 coaxial to the axis 4, that the entire digging unit 3 can also be withdrawn through the tube 14 into a starting pit 15 created at the entrance of the tunnel 9, and can be returned from there back into the working tube 1.

Figure 2:
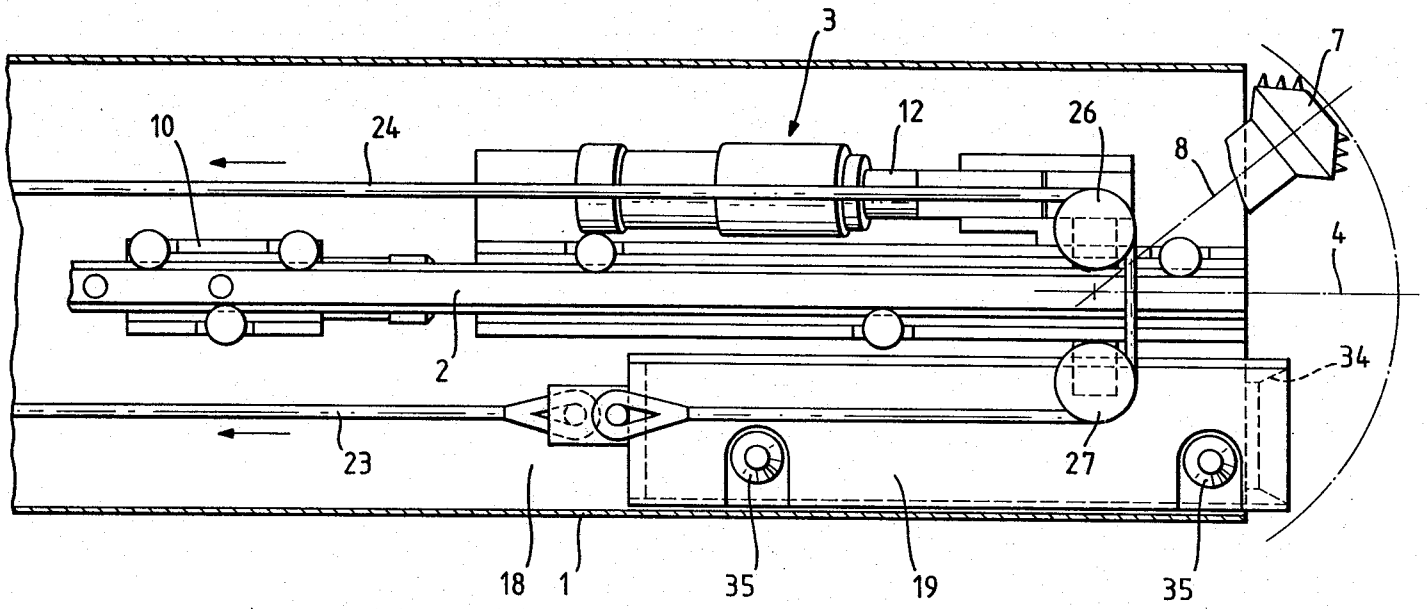
FIG. 2 is an enlarged detail of the apparatus of FIG. 1.

In FIGS. 1 to 4, a shuttle 17 which can run back and forth in a space 18 underneath the digging unit 3, serves to carry away the dirt cut from the working face by the cutterhead 7. This shuttle has a dirt carrier which is preferably configured as a scoop 19 having an open mouth 20 (FIG. 4) at its front end facing the working face. The scoop 19 lies at least partially on the floor of the working tube 1 by having its bottom of a shape conforming to the floor of the working tube, and can therefore be drawn back and forth on the floor of the working tube 1, parallel to its axis. As seen in FIGS. 1 and 2, a transport means associated with it has preferably a reversible driving mechanism containing at least two winches arranged behind it in the direction of the axis 4, each having a drum 21 and 22 and a rope 23 and 24, preferably sufficiently stable wire ropes. Both of the drums 21 and 22 are disposed, for example, in the starting pit 15. The free end of the rope 23 wound on the drum 21 runs through the tubes 14 and 1 and is fastened to a hitch 25 provided on the back end of the scoop 19. On the other hand the rope 24 wound on the drum 22 also runs through the tubes 14 and 1, but then passes over two pulleys 26 and 27 journaled vertically one over the other on the front end of the working tube 1, and is then fastened to a hitch 28 likewise provided on the back end of the scoop 19. Therefore the rope 23 serves, when the drum 21 rotates in the direction of an arrow v, to pull the scoop 19 out of the working tube 1 and out of the tubes next following it, all the way into the starting pit 15, while at the same time the rope 24 is unwound from the drum 22. When the drum 22 rotates in the direction of an arrow w, however, the rope 24 serves to pull the scoop 19 out of the starting pit 15 into the working tube 1, while at the same time the rope 23 is unwound from the drum 21. Moreover, by turning the drums 21 and 22 alternately one way and the other, the scoop 19 can be alternately advanced beyond the front end of the working tube 1 and pulled all the way back into it. If, in accordance with FIG. 1, a tube 14 of reduced inside cross section is disposed in back of the working tube 1, the bottom of the working tube 1 should then have at its rear end a ramp 29 by which the scoop 19 can slide over the step between the floor of the working tube 1 and the floor of the inner tube 14. At the same time the size of the scoop 19 is of course to be selected such that, even when sliding onto the ramp 29, it will not come in contact with the digging unit 3, at least not when the latter is in its full-forward position.

Figure 3:
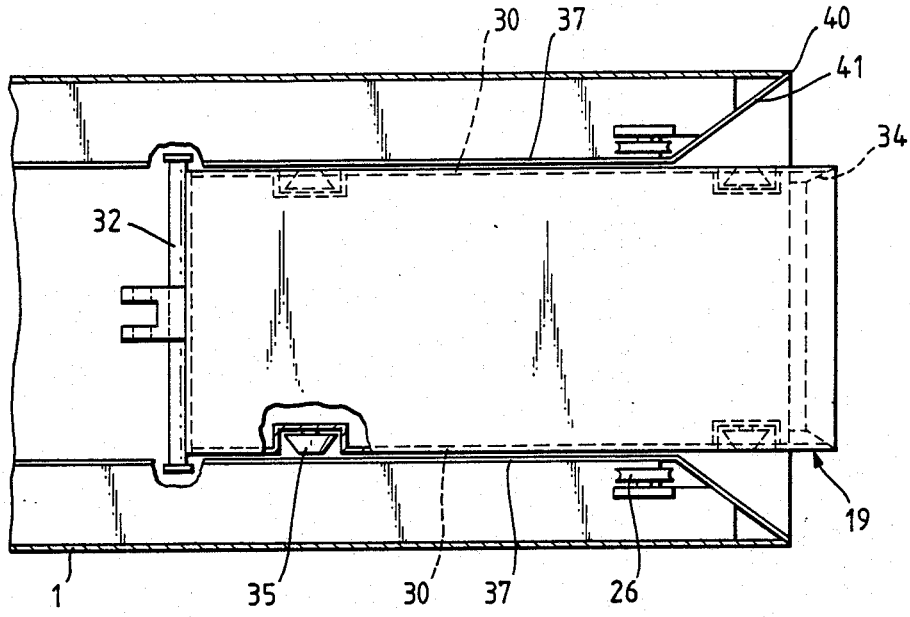
FIG. 3 is a diagrammatic, partially cut-away, horizontal section through the apparatus of FIG. 2.
Figure 4:
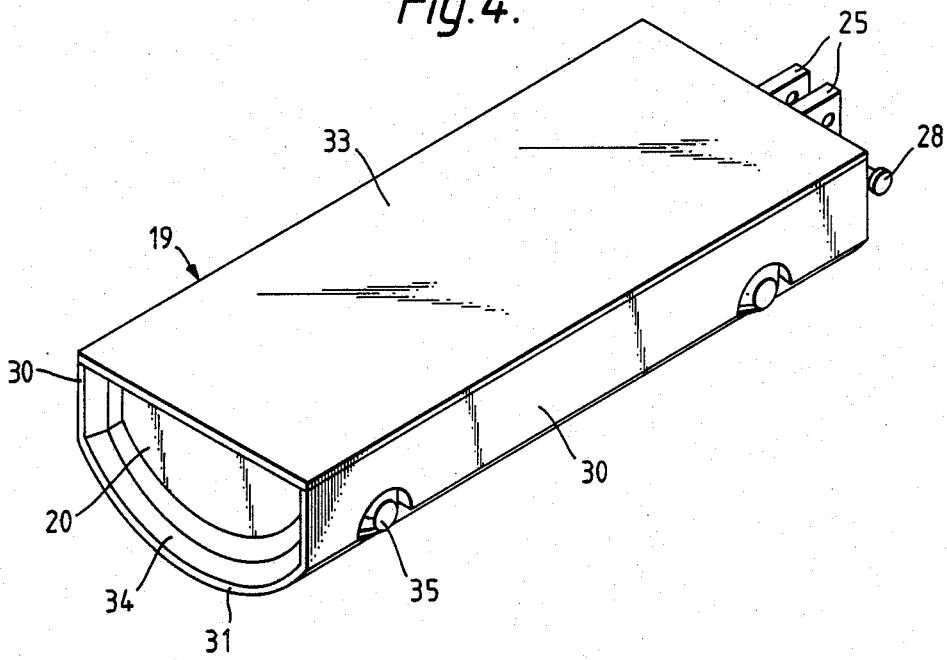
FIG. 4 is a perspective view of a scoop of the carrier system of FIGS. 1 to 3.

In FIGS. 3 and 4, the box-like scoop 19 has two parallel sidewalls 30, a bottom 31 joining them and curved to match the floor of the working tube, a back wall 32 and a cover 33 which is best in the form of a removable or hinged cover. The mouth 20 is best at least partially surrounded by a cutting edge 34 to facilitate the plunging of the scoop 19 into the dirt already loosened in front of the working tube 1. Journaled in the sidewalls 30 of the scoop 19 are diagrammatically indicated wheels 35, casters or the like, which facilitate the movement of the scoop 19 on the floor of the working tube 1.

The scoop 19, like the digging unit 3, can be guided laterally by rails or the like, which are fastened to the inside walls of the working tube 1 and of the tubes following it. To make it less likely for the scoop 19 to capsize when hauled back into the starting pit or pushed forward into the working tube 1, two hitches 25 are provided on its rearward end, close to its longitudinal axis, and two hitches 28 are provided, one on each sidewall 30, with each of which there is associated a rope 23 and 24 and a drum 21 and 22, respectively. In this arrangement the scoop 19 is transported in each direction by two winches which engage it symmetrically. If a tube 14 of smaller inside cross section is disposed in back of the working tube 1, the distance between the sidewalls 30 must not be greater than the inside cross section of the tube 14. In order to obtain a secure lateral guidance in the working tube 1 in this case, two vertically disposed guide walls 37 parallel to the axis 4 and parallel to one another are fastened by means of supports 36 to its inner wall, the distance between them corresponding to the distance between the sidewalls 30. These guide walls 37 serve as lateral guides for the scoop 19. Furthermore, the bottom 31 of the scoop 19 is preferably curved to match the floor of tube 14 of reduced cross section. Thus the scoop 19 is carried only on the wheels 35 or the like, in the tube 14 and in any succeeding tubes of corresponding cross section, the ropes 23 and 24 serving also as guide means, while the scoop 19 is guided in the working tube 1 substantially only between the guide walls 37 and slides on the floor of the working tube. To obtain a reliable passage when the scoop 19 moves from the tube 14 into the working tube 1, additional guides can be provided, at least at the end of tube 14 facing the working tube, which will automatically align the scoop 19 such that it will not collide with the rearward ends of the guide walls 37.

Figure 5:
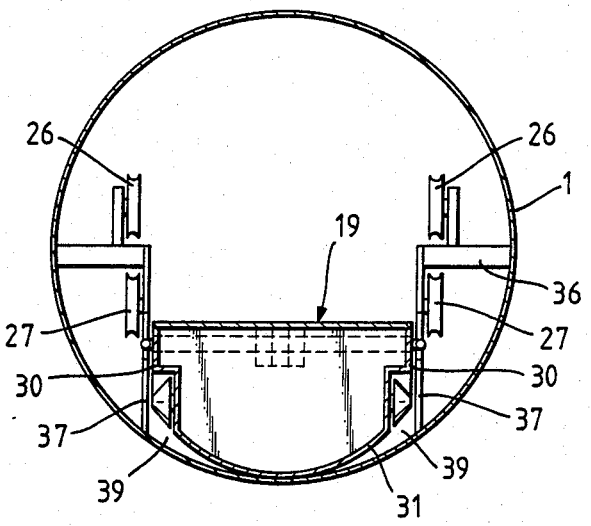
FIGS. 5 and 6 are front views of a working tube and of a casing tube following it, respectively, approximately in the areas of cross-section lines V—V and VI—VI of FIG. 1, the scoop being visible in each case.
Figure 6:
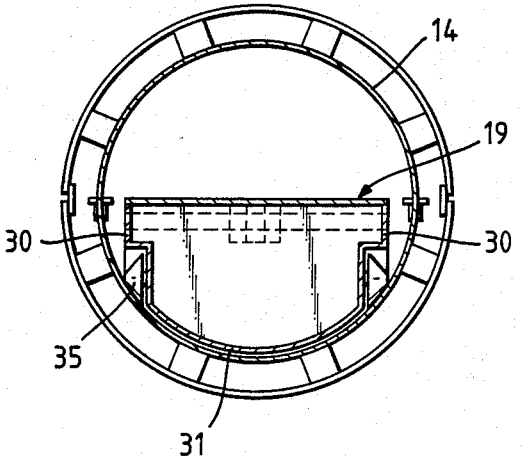

On account of the greater curvature of the bottom 31 of the scoop 19 (FIGS. 5 and 6) provision can in this case also be made for additional guide means on the floor of the working tube 1 which constitute prolongations of the bottom of tube 14 and prevent free spaces 39 seen in FIG. 5 from forming between the scoop 19, the working tube floor and the guide walls 37, in which dirt and stones might become packed. In this embodiment the ramp 29 (FIG. 1) can be omitted. If it is necessary to have tubes of greater cross section following tube 14, measures can be taken such as the ones contemplated in the area of the abutment between the tube 14 and the working tube 1.

FIGS. 5 and 6 again show the position and arrangement of the pulleys 26 and 27 which are provided when the scoop 19 of FIG. 4 is used on both sides of the working tube 1 and which are journaled on the supports 36 and guide walls 37. The ropes 23 and 24 are omitted for the sake of clarity.

Lastly, provision can be made in accordance with FIG. 3 for the guide walls 37 to diverge wedge-wise or conically toward the front end of the working tube 1. This will result on the one hand in sharp edges 40 so that the advancement of the working tube will not be hampered. On the other hand, funnel-like ramp surfaces 41 are formed between the guide walls 37 and the edges 40, which gather the material loosened from the wall of the tunnel and feed it to the area between the two guide walls 37. Therefore all of the material cut loose from the working face can be reliably shoveled up and carried away by running the scoop 19 forward and backward, even if its width is smaller than the width of the inside cross section of the working tube 1.

The manner of the operation of the apparatus described is as follows:

After the starting pit 15 is excavated the front end of the working tube 1 is applied to the wall through which the tunnel is to be bored and the creation of the tunnel 9 is commenced in a known manner (DE-OS No. 34 23 842). After a portion of the tunnel is completed—e.g., a portion 250 mm long, the cutterhead 7 is brought to a horizontal position or a position raised above the axis 4 as shown in FIG. 1. Now the scoop 19 is inserted into the working tube 1 and the necessary number of winches 21, 23, and 22, 24, are installed, the drums 21 and 22 being fixedly mounted in the starting pit. By rotating the drums 22 in the direction of the arrow w, the scoop 19 is pushed into the working tube 1 until its front end emerges from the front end of the working tube 1 in the manner seen in FIGS. 1 to 3, thus plunging into the dirt loosened from the working face and taking it in through its mouth 20. To limit the forces required for this purpose the scoop is best not moved just once into the working tube, but is moved repeatedly back and forth in short, successive strokes, until all of the loose dirt has been scooped up. Then the scoop 19 is withdrawn into the startinq pit 15 by rotating the drum 21 in the direction of the arrow v, and emptied.

The creation of the tunnel 9 is then continued, by first driving the working tube 1 into the completed tunnel section by means of pneumatic or hydraulic jacks or the like, not shown, acting for example on a ring 42 (FIG. 1) placed at the rearward end of the working tube 1, and the operations described above are then repeated.

After the working tube 1 has completely disappeared into the tunnel 9, additional tubes of the same outside cross section are driven in behind it to shore up the areas left behind it. Additional rails, guides or the like are mounted on the inside walls of the latter tubes to permit easy withdrawal of the scoop 19 into the starting pit 15 and its reintroduction into the working tube, and, if need be, to remove and reintroduce the entire digging unit 3.

The invention is not limited to the embodiment described, which can be modified in many different ways.

When introducing tubes following the working tube 1, especially tube 14, to avoid the necessity of threading the ropes 23 and 24 through these tubes, tubes can be used, for example, which consist of at least two parts divided parallel to the axis 4 and therefore can be placed around the already-installed ropes 23 and 24 and any other supply lines or the like that may be present. Tubes of this kind are known (DE-OS No. 33 40 256).

When a working tube 1 having an outside cross section of 1000 mm is used, the above-described scoop 19 can have, for example, a width of about 600 mm and a height of about 400 mm, while its length will depend on the length of the working tube 1 and the conditions involved. Such a scoop 19 could be supported on four wheels 35, as in FIG. 4, although a greater or lesser number of wheels 35 can be provided. The winches are preferably driven by hydraulic or electric motors with capacities of, for example, 30,000 Newtons. Alternatively it would also be possible to provide different driving mechanisms than the described winches and to make the scoop 19 self-powered so that it can enter into the tube 1 under its own power or travel back from there to the starting pit. Within the working tube 1 itself, the scoop is best coupled to additional pneumatic or hydraulic drives which impart to it the movements necessary for gathering the loose dirt.

The advantages of the described scoop 19 consist especially in the fact that it is of simple design, long-wearing, and economical, and can easily be maintained and repaired. Also, in contrast to the use of chain conveyors, conveyor belts, pusher systems or the like, there is no need to constantly lengthen the entire conveyor system to match the number of pipes added behind the working tube 1, because even if winches are used, the length of the ropes 23 and 24 can easily be made as long as corresponds to the length of the longest tunnel 9 to be made. Lastly, the use of the scoop 19 also permits the use of a very large mouth 20 in relation to the cross section of the working tube 1, which will permit not only plain dirt to be hauled away but also rocks and other bodies of relatively great cross section present in the dirt.

Figure 7:
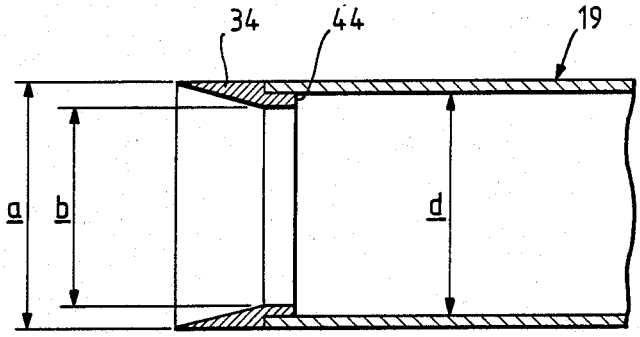
FIGS. 7 and 8 are diagrammatic sections through two forms of cutting edge that can be used for the scoop of FIGS. 1 to 6.
Figure 8:
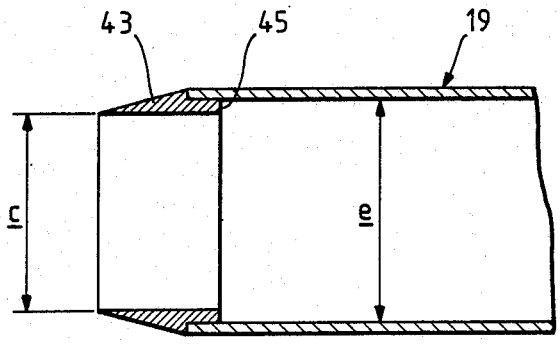

Unlike the manner shown in FIGS. 3 and 4, the scoop can have in the forward area a cover affixed to the sidewalls and in the rearward area it can be open. Furthermore, the hitches 25 and 28 can be mounted on a flap forming the back end of the scoop. In this case the scoop is easily emptied by lifting up the front end with the rear flap open. It is furthermore possible to omit the wheels 35 entirely and let the scoop simply slide in the tubes. Lastly, the forward cutting edge 34 can be configured differently from FIGS. 3, 4 and 7. In this embodiment the mouth through which the dirt enters can taper conically inward from the maximum cross section of the scoop. Therefore the excavated earth of the cross section a can be taken up and then forced through a narrowed cross section b and thus compressed. Alternately, however, the cross-sectional shape shown in FIG. 8 can be provided, in which the mouth has the same cross section c throughout, and instead the outer periphery can flare conically up to the greatest cross section of the scoop, and the scooped dirt is pressed into the scoop without that kind of compression. Combined cross-sectional shapes are also possible. It has been found to be especially desirable to configure the cutting edge at the side walls and cover as in FIG. 8, but to configure it at the floor as in FIG. 7. This largely prevents any compression of the scooped dirt. At the same time the dirt is prevented from getting under the bottom of the scoop. It is especially desirable to provide in the front part of the scoop 19 an expansion of the cross section along a step 44 (FIG. 7) and 45 (FIG. 8). Thus the advantage is achieved that the dirt can expand to a greater cross section d (FIG. 7) or e (FIG. 8) in a section of the scoop situated in back of its mouth. This substantially reduces the wall friction of the dirt in the rear part of the scoop. Without this expansion of the cross section the friction of the dirt along the walls of the scoop can become so great that the scoop will be able to fill only partially.

We claim:

1. Apparatus for underground tunneling, especially for tunnels of unwalkable cross section, containing: a working tube (1) having an axis (4), which can be urged forward in the direction of the tunnel in formation, a digging unit (3) which is mounted in the working tube and can be pushed past the front end of the working tube, and which is movable radially of its axis and bears a partial-face cutter for loosening the dirt in front of the working tube and can be set for a substantially smaller outside cross section in comparison to the inside cross section of the working tube, and a carrier system for the removal of the dirt loosened in the driving of the tunnel, the carrier system containing a scoop (19) which is movable underneath the digging unit substantially parallel to the working tube axis and contains a transport system (21–24) coupled to the scoop; the scoop being mounted on the floor of the working tube (1) such that it can be pushed forward partially past its front end and withdrawn again fully into the working tube, and has at its front end a mouth (20) of shovel-like configuration for the loading of the loosened dirt; and wherein the transport system contains a reversible drive mechanism for moving the scoop back and forth when loading, for withdrawing the scoop (19) rearwardly from the working tube (1) for the removal of the dirt, and for returning the scoop (19) into the working tube (1) after it has been emptied.

2. Apparatus in accordance with claim 1, characterized in that the mouth (20) is surrounded at least partially by a margin configured as a cutting edge.

3. Apparatus in accordance with claim 1, characterized in that the scoop (19) has two parallel sidewalls (30) and the working tube (1) two parallel guiding walls (37) disposed at a distance from the sidewalls and cooperating with the latter.

4. Apparatus in accordance with claim 3, characterized in that the guiding walls (37) are joined at the front end of the working tube (1) to the working tube periphery by ramp surfaces (40).

5. Apparatus in accordance with claim 1, characterized in that the scoop (19) is provided with rollers or wheels (35) journaled on it and intended for support on the working tube floor.

6. Apparatus in accordance with claim 1, characterized in that the scoop is closed on its top with a removable or hinged cover (32).

7. Apparatus in accordance with claim 1, characterized in that the drive mechanism has at least two winches disposed behind the scoop (19) in the direction of the working tube axis (4) and composed of drums (21, 22) and ropes (23, 24), the ropes (23, 24) being joined at their one end to the drums and at their other end to the scoop.

8. Apparatus in accordance with claim 7, characterized in that the rope (23) of at least one winch is carried directly from the drum 21 to the scoop (19), while the rope (24) of at least one additional winch is carried to the scoop (19) from the drum (22) over pulleys (26, 27) journaled at the front end of the working tube (1).

9. Apparatus in accordance with claim 7, characterized in that the length of the ropes (23, 24) corresponds at least to the length of the tunnel (9) to be made.

10. Apparatus in accordance with claim 1, characterized in that the scoop (19) has an expanded cross section situated in a section situated in back of the mouth (20).

* * * * *